US005299501A

United States Patent [19]

Anderson

[11] Patent Number: 5,299,501

[45] Date of Patent: Apr. 5, 1994

[54] FRANGIBLE ARMOR PIERCING INCENDIARY PROJECTILE

[75] Inventor: Richard V. Anderson, Arlington, Tex.

[73] Assignee: BEI Electronics, Inc., San Francisco, Calif.

[21] Appl. No.: 18,084

[22] Filed: Feb. 16, 1993

Related U.S. Application Data

[62] Division of Ser. No. 590,473, Sep. 28, 1990, Pat. No. 5,198,616.

[51] Int. Cl.[5] ..... F42B 12/04; F42B 12/44

[52] U.S. Cl. ..... 102/364; 102/473; 102/518

[58] Field of Search ..... 102/364, 506, 514–518, 102/365, 389, 473

[56] References Cited

U.S. PATENT DOCUMENTS

| | | | |
|---|---|---|---|
| 3,213,792 | 10/1965 | Grenander et al. | 102/517 |
| 4,108,072 | 8/1978 | Trinks et al. | 102/518 |
| 4,381,692 | 5/1983 | Weintraub | 102/364 |
| 4,381,712 | 5/1983 | Black | 102/503 |
| 4,671,181 | 6/1987 | Romer et al. | 102/518 |
| 4,836,108 | 6/1989 | Kegel et al. | 102/506 |
| 4,854,242 | 8/1989 | Katzmann | 102/506 |
| 4,872,409 | 10/1989 | Becker et al. | 102/517 |
| 4,895,077 | 1/1990 | Miethlich et al. | 102/517 |
| 4,970,960 | 11/1990 | Feldmann | 102/506 |
| 5,097,766 | 3/1992 | Campoli et al. | 102/364 |

FOREIGN PATENT DOCUMENTS

| | | | |
|---|---|---|---|
| 538268 | 7/1941 | United Kingdom | 102/517 |

*Primary Examiner*—Harold J. Tudor
*Attorney, Agent, or Firm*—Palmatier & Zummer

[57] ABSTRACT

The projectile, adapted to be fired from an automatic cannon, comprises a frangible porous brittle generally cylindrical casing having a tapered nose portion and made of a molded sintered powder material preferably consisting predominantly of 60 to 100% type 316 stainless steel powder, the remainder being pure iron powder. The rear end of the casing is formed with an axial bore wherein a hard dense penetrator rod is received, preferably made of tungsten or tungsten carbide. Behind the penetrator rod, the casing has an enlarged bore wherein an incendiary pellet is received, preferably comprising zirconium crystals molded in an epoxy matrix. A massive closure plug closes the enlarged bore behind the incendiary pellet. Upon impact with a target, the frangible casing disintegrates into granular fragments while the penetrator rod punches a hole in the target through which the fragments are propelled. The incendiary pellet is ignited by heat generated therein by molecular disruption when the pellet is compressed or forced through the hole by the massive closure plug, whereby ignited incendiary particles are energetically propelled through the hole.

7 Claims, 1 Drawing Sheet

FRANGIBLE ARMOR PIERCING INCENDIARY PROJECTILE

This application is a division of application Ser. No. 07/590,473, filed Sep. 28, 1990 now U.S. Pat. No. 5,198,616.

FIELD OF THE INVENTION

This invention relates to a frangible armor piercing incendiary projectile which is particularly well adapted for use in air defense, but also is advantageously usable for other ordnance applications. The projectiles of the present invention are well adapted to be fired from small caliber, rapid fire guns, ranging in caliber from 20 mm to 35 mm, for example.

BACKGROUND OF THE INVENTION

Fragmentation projectiles are well known in the prior art. Typically, a fragmentation projectile has a casing which is adapted to be fragmented by an internal explosive charge that is detonated by impact with the target or by a time fuse. Such fragmentation projectiles are rather dangerous to handle, because each projectile has an internal explosive charge.

Frangible non-metallic ceramic projectiles have been made and used as inexpensive practice rounds.

Various kinds of armor piercing projectiles are also well known in the prior art. The same is true of various kinds of incendiary projectiles. Typically, an incendiary projectile includes an internal incendiary material which is ignited by an internal explosive charge.

OBJECTS OF THE INVENTION

One object of the present invention is to provide a new and improved ordnance projectile having a body or casing which is frangible into a multitude of granules or particles, upon impact of the body with a target, whereby the projectile is an effective weapon against both personnel and material. The high energy of the impact causes the granules to scatter in all directions with great force, even though the projectile does not utilize an internal explosive charge.

A further object is to provide a new and improved projectile of the foregoing character having a hard and heavy penetrator rod mounted within the frangible body and adapted to be guided by the frangible body into a direct armor piercing impact with the target.

Another object of the present invention is to provide a new and improved projectile of the foregoing character, having an incendiary component or pellet, mounted within the frangible body and adapted to be ignited by the heat generated as a result of molecular disruption when the projectile smashes against the target.

SUMMARY OF THE INVENTION

To accomplish these and other objects, the invention may provide an ordnance projectile, comprising a generally cylindrical body or casing having a tapered nose portion thereon, the body being made of a brittle, porous, molded, sintered powder material consisting predominantly of stainless steel powder for imparting frangibility to the body whereby the body is frangible into a multitude of granules upon impact of the body with a target.

In one embodiment of the invention, the stainless steel powder material consists substantially of type 316 stainless steel powder.

The powder material may comprise a major proportion of stainless steel powder and a minor proportion of substantially pure iron powder.

The proportion of stainless steel powder may range from substantially 60% to substantially 100% by weight, while the proportion of the substantially pure iron powder may range from substantially 40% by weight to substantially zero.

The stainless steel powder may consist substantially of type 316 stainless steel powder.

The projectile may be adapted to be fired from a gun barrel having rifling therein and may comprise a frangible porous generally cylindrical body made of frangible molded sintered powder material consisting substantially of a metal powder, the body having a generally cylindrical peripheral portion and a tapered nose portion thereon, the projectile comprising a substantially circular rotator ring securely mounted around the generally cylindrical peripheral portion of the body and adapted to be rotated by the rifling in the barrel, the ring being made of a soft malleable metal material for engagement with the rifling.

The rotator ring may have an inner portion which is securely embedded in the peripheral portion of the body.

The inner portion of the ring may have a plurality of inwardly projecting teeth, embedded in the body and interlocking therewith, whereby rotation of the ring is reliably transmitted to the body.

The ring is preferably made of molded sintered powder material consisting essentially of soft metal powder material.

The soft metal powder material may consist essentially of pure iron powder.

In another aspect, the present invention may provide an ordnance projectile, comprising a frangible porous generally cylindrical body or casing made of a frangible molded sintered powder material consisting substantially of a metal powder, the body having a tapered nose portion thereon, the body having an internal axial guide opening thereon disposed behind the nose portion, and a penetrator rod snugly received in the axial guide opening, the body having retainer means for securing the penetrator rod within the body for propulsion therewith.

The metal powder may consist predominantly of stainless steel powder, preferably type 316 stainless steel powder, for imparting frangibility to the body whereby the body is frangible into a multitude of granules upon impact of the body with a target.

The penetrator rod is preferably made of a hard composition containing a heavy metal. The hard composition preferably consists predominantly of tungsten.

As another alternative, the composition may consist predominantly of tungsten carbide.

The retainer means may comprise a rear closure member forming a rear wall for the body.

The retainer means preferably comprises a rear closure plug.

The projectile preferably includes an incendiary component disposed in the body behind the penetrator rod.

The axial guide opening in the body preferably has a rear portion for receiving the incendiary component.

The rear portion of the axial guide opening is preferably enlarged for snugly receiving the incendiary component, such member having a larger diameter than the diameter of the penetrator rod.

The incendiary component preferably comprises a material which is heated to an ignition temperature by molecular disruption due to the impact of the projectile with the target.

The incendiary component preferably comprises zirconium which is heated to an ignition temperature by molecular disruption due to the impact of the projectile with a target.

The incendiary component preferably comprises zirconium crystals in an epoxy matrix.

The retainer means of the projectile preferably comprises a rear closure member forming a rear wall of the body, the incendiary component being snugly received between the penetrator rod and the rear closure member.

The rear closure member preferably comprises a massive rear closure plug for the body.

The present invention also provides a method of making a brittle frangible casing for a projectile adapted to be fired from a cannon, such method comprising the steps of preparing a powder mixture consisting predominantly of a metal powder and a minor proportion of graphite powder mixed therewith, the proportion of the graphite powder ranging from approximately 0.2% to approximately 2% by weight, the proportion of the metal powder ranging from approximately 99.8% to approximately 98% by weight, the metal powder consisting predominantly of stainless steel powder, pressing such powder material into a casing mold, the powder material thereby being compressed to a density ranging from approximately 0.21 to approximately 0.24 of a pound per cubic inch, and sintering the molded powder in an inert atmosphere at a temperature ranging from approximately 1500° F. to approximately 1700° F. for a time sufficient to unite the molded powder into a brittle porous frangible casing, the graphite powder vaporizing and escaping from the molded powder material during the sintering step.

Preferably, the proportion of the graphite powder is approximately 0.8% by weight, and the proportion of the metal powder is approximately 99.2% by weight.

Preferably, the metal powder comprises a major proportion of type 316 stainless steel powder and a minor proportion of pure iron powder.

Preferably, the sintering temperature is substantially 1600° F.

The preferred proportion of the graphite powder is substantially 0.8% by weight, and the preferred proportion of the metal powder is substantially 99.2% by weight.

Preferably, the metal powder consists substantially of type 316 stainless steel powder having a proportion ranging from 60% to 100% by weight, the remainder of said metal powder consisting substantially of pure iron powder.

If cost is no object, the metal powder preferably consists of substantially 100% of the type 316 stainless steel powder.

For the sake of economy, the metal powder may consist substantially of 60% type 316 stainless steel powder by weight and 40% pure iron powder by weight.

The method may comprise the additional step of inserting a rotator band into a portion of the casing mold, the powder material being molded and sintered within the rotator band whereby the rotator band is securely united with a portion of the completed casing.

The present invention also provides a method of making a casing for a projectile adapted to be fired from a cannon, the method comprising the steps of preparing a powder mixture consisting predominantly of metal powder, producing a rotator band made of soft metal material, providing a casing mold, inserting the rotator band into a portion of the casing mold, molding the powder material by pressing it into the casing mold and within the rotator band, and sintering the molded powder material at a sufficiently high temperature and for a time sufficient to unite the molded powder material to form a casing which is securely united with the rotator band.

The rotator band may be formed with inwardly projecting teeth for interlocking with the molded and sintered casing.

BRIEF DESCRIPTION OF THE DRAWINGS

Further objects, advantages and features of the present invention will appear from the following description, taken with the accompanying drawings, in which.

DETAILED DESCRIPTION OF ILLUSTRATIVE EMBODIMENTS

Figure 7:
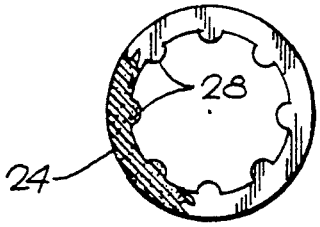
FIG. 7 is an end view of a rotator ring, adapted to be mounted around the body or casing of the projectile, the view being partly in section along the broken line 7—7 in FIG. 1.
Figure 4:
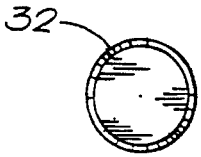
FIG. 4 is an end view of the incendiary pallet of FIG. 3.
Figure 6:
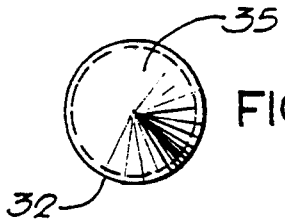
FIG. 6 is an end view of the closure plug shown in FIG. 5.

As just indicated, the drawings illustrate a projectile 10 adapted to be fired from an automatic cannon or some other gun, which may range in caliber from 20 to 35 mm, for example. The invention is also applicable to larger and smaller calibers. The illustrated projectile 10 comprises a generally cylindrical body or casing 12 having a conically tapered nose portion 14. The body 12 is illustrated as being made in two pieces or components 16 and 18, but the body 12 may also be molded or otherwise made in one piece, if desired. The first or rear component 16 is illustrated as being formed at its front end with an axial cylindrical bore 20 for telescopically receiving a reduced cylindrical rear portion 22 on the second or front component 18. The components 16 and 18 are securely bonded together so that they are effectively united into a single entity.

Both components 16 and 18 of the body 12 are made of a brittle porous molded sintered powder material consisting predominantly of stainless steel powder, for imparting frangibility to the body 12, whereby the body is frangible into a multitude of granules upon impact of the body with a target. The stainless steel powder preferably takes the form of type 316 stainless steel powder or some other similar material which will impart the desired frangibility to the body 12.

It is believed that the use of substantially one hundred percent of the type 316 stainless steel powder in the powder material provides the best frangibility characteristics for the body or casing 12. However, the powder material may comprise a major portion of type 316 stainless steel powder and a minor portion of substantially pure iron powder. The proportion of the stainless steel powder may range from substantially 60% to substantially 100% by weight, while the proportion of the iron powder may range from substantially 40% by weight to substantially zero. The use of the iron powder reduces the cost of the body or casing 12, because the iron powder is much less expensive than the type 316 stainless steel powder. For example, the iron powder may cost about 12 cents per pound, while the type 316 stainless steel powder may cost about 65 cents per pound. If economy is no object, the metal powder material preferably comprises 100% of the type 316 stainless steel powder. If too much soft iron powder is used, the sintered body or casing 12 will not have the desired frangibility.

The method of making the body or casing 12 will be described in greater detail presently.

The body or casing 12 is provided with a rotator band or ring 24 which is made of a soft metal material, preferably soft iron, and is adapted to engage the rifling in the bore of a gun barrel, so that the rifling is effective to produce rotation of the projectile 10 about its longitudinal axis. The rotator band 24 is received in and interlocked with a peripheral groove 26 formed in the rear portion of the frangible body or casing 12. The rotator ring 24 may be machined or otherwise formed from solid soft iron. However, the rotator band 24 is preferably made by molding and sintering substantially pure iron powder, in a manner which is known to those skilled in the art, so as to produce a solid soft iron band or ring.

The rotator band 24 is preferably formed with a plurality of spaced teeth or projections 28, extending inwardly from the inner periphery of the band, for interlocking with the body or casing 12. The groove 26 in the body 12 is formed with recesses 30 spaced around the bottom of the groove 26, for receiving and interlocking with the teeth 28.

As already indicated, the rotator band 24 is preferably made by pressing substantially pure soft iron powder into a mold which imparts the desired shape to the compressed powder material. The molded rotator band 24 is then sintered at a sufficiently high temperature to unite the particles of the iron powder into a solid soft iron material. The sintered rotator band 24 does not require any machining. The completed rotator band 24 is then preferably inserted into a mold which is to be employed to form the body 12. Next, the metal powder mixture for producing the body 12 is pressed into the mold so that the peripheral groove 26 is molded into the body with exactly the complementary shape to interlock with the inwardly projecting teeth 28 on the rotator band 24.

As previously indicated, the metal powder material for molding the body 12 consists predominantly of type 316 stainless steel or some other similar material which will impart the desired frangibility to the body 12. However, a minor proportion of graphite powder is mixed with the metal powder material. The proportion of the graphite powder may range from approximately 0.2% to approximately 2% by weight. It is believed that the optimum proportion of graphite powder is approximately 0.8%. If economy is no object, the remainder of the powder mixture comprises type 316 stainless steel powder. However, substantially pure iron powder may be substituted for a minor percentage of the type 316 stainless steel powder, up to approximately 40% of the pure iron powder by weight, in which case the proportion of the type 316 stainless steel powder is reduced to approximately 60% by weight.

The powder material is pressed into the mold with a sufficient pressure so that the density of the molded powder material ranges from approximately 0.21 to approximately 0.24 of a pound per cubic inch. It is believed that the optimum density is approximately 0.23 of a pound per cubic inch. The molded body 12 is then sintered in an inert gas atmosphere at approximately 1600 degrees Fahrenheit, which is believed to be the optimum temperature. The sintering temperature may range between approximately 1500 and 1700 degrees Fahrenheit. The heat of the sintering process causes the graphite to vaporize, so that the graphite escapes and is not present in the completed body 12. The escape of the graphite produces minute voids in the sintered material so that porosity is imparted to the sintered material. The porous sintered material is frangible, so that the body or casing 12 disintegrates into a multitude of granules when the body 12 of the projectile 10 strikes a target. The size of the granules is about the same as the size of peas or corn kernels. The granules are propelled outwardly in every direction with great energy when the body or casing 12 strikes the target.

The projectile 10 is preferably provided with a penetrator in the form of a penetrator rod 32 which is received and guided in an axial bore or opening 34 molded or otherwise formed in the body or casing 12. As shown, the bore 34 is formed axially in both of the components 16 and 18 of the body or casing 12. As shown, the penetrator rod 32 is generally cylindrical in shape and is formed with a generally conical point 35. The penetrator rod 32 is made of a very hard, dense, heavy material, such as tungsten or tungsten carbide. According to one method, the penetrator rod 32 may be formed by machining tungsten bar stock, in which case the tungsten rod may be carbided if desired. However, the penetrator rod 32 is preferably molded and sintered from powdered tungsten or tungsten carbide. Another method of producing the penetrator rod 32 is to form powdered tungsten or tungsten carbide by a rapid omnidirectional compaction (ROC) process. If the penetrator rod 32 is formed from powder, no further machining is required.

The projectile 10 is also preferably provided with an incendiary component or pellet 36, snugly received in an axial bore or opening 38 which is molded or otherwise formed in the body or casing 12, immediately behind the bore 34 in which the penetrator rod 32 is received. The illustrated incendiary component or pellet 36 is generally cylindrical and is substantially larger in diameter than the penetrator rod 32. Similarly, the bore 38 is enlarged relative to the bore 34 in which the penetrator rod 32 is received. The incendiary component or pellet 36 is disposed immediately behind the penetrator rod 32.

The incendiary component or pellet 36 is retained in the body 12 by a retainer member comprising a massive closure member, illustrated as a closure plug 40 which is securely mounted in an axial bore or opening 42, molded or otherwise formed in the rear end of the body 12. The closure plug 40 is machined or otherwise formed from a corrosion resistant material such as stainless steel.

Figure 1:
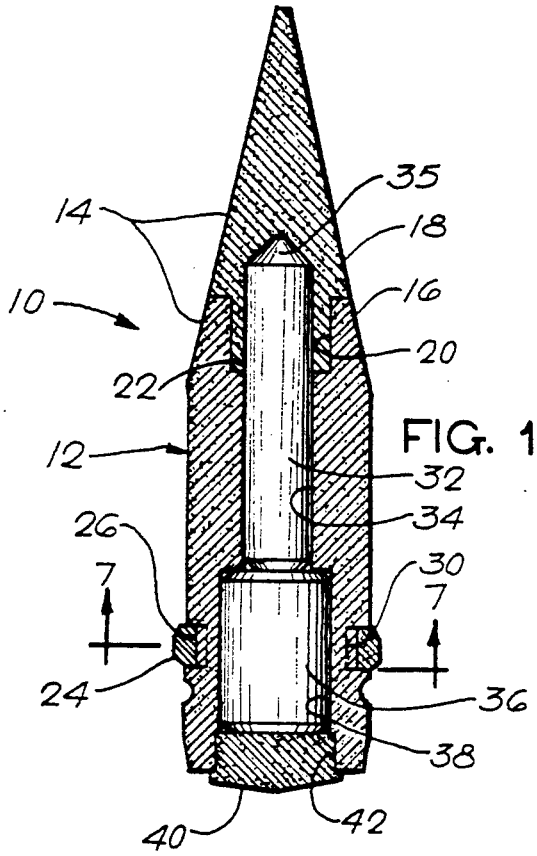
FIG. 1 is an elevational view, partly in longitudinal section, of a projectile to be described as an illustrative embodiment of the present invention.
Figure 2:
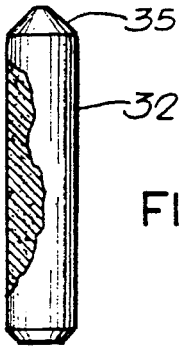
FIG. 2 is an elevational view, partly in longitudinal section of a penetrator rod, mounted axially within the body or casing of the projectile, as shown in FIG. 1.
Figure 8:
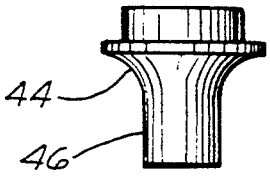
FIG. 8 is an elevational view showing a modified closure plug, similar to the closure plug of FIG. 5, but having a rear portion for receiving a tracer pellet.
Figure 3:
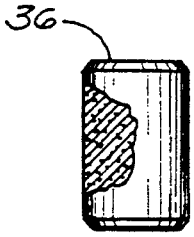
FIG. 3 is an elevational view, partly in longitudinal section, of an incendiary pallet or member, mounted axially within the projectile, as shown in FIG. 1.
Figure 9:
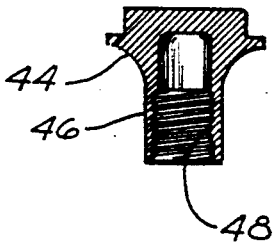
FIG. 9 is a longitudinal section, taken through the modified closure plug of FIG. 8.
Figure 5:
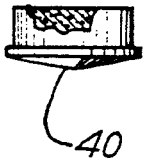
FIG. 5 is an elevational view, partly in section, of a rear closure member or plug for the body or casing of the projectile, shown in FIG. 1.

An alternative closure plug 44, shown in FIGS. 8 and 9, may be substituted for the closure plug 40 of FIGS. 1 and 5. The alternative closure plug 44 has a rearwardly extending axial projection 46 formed with a threaded bore or opening 48 for receiving any suitable tracer component, not shown.

The incendiary component or pellet 36 is made of a material which will ignite due to the extreme heat which is produced by molecular disruption when the projectile 10 strikes a target.

The incendiary component or pellet 36 is preferably formed from a mixture consisting substantially of zirconium metal crystals and an epoxy matrix. The mixture is compressed in a molding die and is then cured. No additional machining is required. The mixture uses the maximum amount of zirconium with only enough epoxy material to fill the spaces between the zirconium crystals. Incendiary pellets of this type are made and sold by Quantum Industries of California under the trademark QAZ.

The projectile 10 of the present invention will compete with several current anti-personnel, air defense and multipurpose projectiles for automatic cannons having calibers from 20 to 35 mm for all branches of the military service.

The frangible armor-piercing projectile 10 is intended to be fired from an automatic cannon or other gun at the highest possible muzzle velocity which is compatible with the safe chamber pressure of the gun employed. Using the highest possible muzzle velocity results in the greatest possible impact energy when the projectile strikes the target, whereby the best possible penetration is achieved.

The soft iron rotator band 24 engages the rifling in the barrel of the gun so that the projectile 10 is rotated about its longitudinal axis. Due to the molding of the body or casing 12 into interlocking engagement with the inwardly projecting teeth 28 on the rotator band 24, the band 24 is very securely united with the body 12, so as to obviate any looseness between the band 24 and the body, while also preventing any possible detachment of the rotator band 24 from the body or casing 12 of the projectile 10. Any loosening or detachment of the rotator band is entirely unacceptable to the Armed Forces.

The frangible body or casing 12 acts as a vehicle or sabot to carry the penetrator component or rod 32 to the target. The frangible body 12 is sufficiently strong to withstand both the forces imposed upon the body 12 in the gun barrel and the forces due to muzzle turbulence when the projectile 10 emerges from the gun barrel.

Due to the high velocity of the projectile 10, the impact of the projectile with a target is highly energetic. When the nose portion 18 of the body 12 strikes the target, the energy of the impact causes the entire body or casing 12 to disintegrate into a large number of fragments or granules, which typically have a size similar to the size of peas or corn kernels. The fragments continue to travel forwardly with high energy, while also being propelled outwardly in all directions.

As the frangible body 12 is fragmented by its impact with the target, the penetrator rod 32 continues to travel forwardly so that it strikes and penetrates the target. The penetrator rod 32 is guided and supported by the fragmenting body or casing 12, so that the penetrator rod is protected against bending or shattering. The penetrator rod 32 punches a hole in the target, even though the target may comprise light armor plate or a hard object such as an engine block. As the penetrator rod 32 passes into and through the hole in the target, the penetrator rod 32 is followed by a considerable proportion of the fragments or granules from the fragmented body or casing 12. After the granules pass through the hole, they spread outwardly in all directions with destructive energy.

The incendiary pellet 36 also follows the penetrator rod 32 through the hole in the target. The momentum of the massive closure plug 40 insures that the incendiary pellet 36 will be forced through the hole, even though the diameter of the incendiary pellet 36 is greater than the diameter of the penetrator rod 32. The impact of the incendiary pellet 36 with the target and the forcing of the incendiary pellet 36 through the hole produce great molecular disruption in the incendiary pellet 36 so that a great amount of heat is generated, sufficient to ignite the zirconium or other incendiary material in the incendiary pellet 36. The combustion of the zirconium is supported by atmospheric oxygen and also by oxygen derived from the epoxy matrix. Flaming particles of the incendiary material from the pellet 36 travel through the hole and spread outwardly within the target so that any combustible material in the target is ignited.

The solid closure plug 40 of FIGS. 1 and 5 is generally employed when the projectile 10 is to be fired from automatic cannons on high performance aircraft. The modified closure plug 44, adapted to receive a tracer pellet, may be employed when the projectile 10 is to be fired from automatic cannons on land vehicles, gun carriages, Naval vessels and helicopters.

Most air defense targets, such as aircraft, missiles and the like, comprise a structure having a thin soft outer skin with numerous interior components having varying degrees of hardness and criticality. Frequently, the most critical components are protected by armor plate. The projectile 10 of the present invention is capable of puncturing the thin outer skin of air defense targets. The puncturing of the outer skin causes the body or casing 12 to fracture and expel high energy fragments into the interior of the target structure. The penetrator rod 32 proceeds through the outer skin and pierces any hard or protected component which may be encountered. The incendiary pellet 36 is ignited by extreme compression and molecular disruption when the body or casing 12 of the projectile 10 strikes the target and is shattered. The ignition of the pellet 36 causes hot incendiary particles to be projected with great force throughout the interior of the target structure, so as to ignite flammable materials such as fuel, fluids and explosives.

The previously described characteristics of the projectile 10 make it ideal for engaging many material targets, such as trucks, communication facilities, command post structures, buildings, rail cars, small ships and boats, field depots and lightly armored vehicles, which are extremely vulnerable to the projectile 10. The frangible body or casing 12 produces fragments upon impact with the target. Such fragments are thrown in all directions with great energy, in a manner comparable to the fragmentation of projectiles containing explosives. The penetrator rod 32 pierces hard components such as engine blocks and light armor. The incendiary pellet 36 produces hot flaming particles which ignite any flammable substances in the impact area.

The molding of the frangible body or casing 12 within the rotator band 24 eliminates any need for several costly machining and forming operations which have been necessary in the manufacture of conventional projectiles. Moreover, the present invention obviates any possible loss or loosening of the rotator band 24 during the firing of the projectile. Such loss or loosening of the rotator band has been a common cause of the failure of conventional projectiles.

The molded and sintered body or casing 12 of the projectile requires very little machining to achieve the desired size and finish, so that machining costs are reduced.

Upon the impact of the projectile 10 with a target, the frangible body or casing 12 is shattered into a multitude of fragments which are thrown outwardly with high energy, to produce a destructive effect similar to that produced by high velocity fragments expelled by a high explosive bursting charge. Unlike the projectile of the present invention, high explosive projectiles require extra components including a fuze, detonator, booster and a high explosive charge to achieve a similar effect. Thus, the present invention eliminates the cost of these extra components. Moreover, the frangible projectiles of the present invention eliminate the safety hazards which are involved in the manufacture, handling, shipping and storage of high explosive projectiles.

The projectile of the present invention produces a great incendiary effect which is not normally produced by conventional armor-piercing projectiles or any projectile without an explosive.

The projectiles of the present invention are inexpensive, easy to fabricate and assemble, and safe to manufacture and handle. High explosive projectiles with a similar overall effectiveness can be twice as expensive, as well as being dangerous to manufacture, handle and ship.

Those skilled in the art will understand that various modifications, alternative constructions and equivalents may be employed, without departing from the true spirit and scope of the present invention, as described in the preceding specification and defined in the following claims.

I Claim:

1. An ordnance projectile, comprising a frangible porous generally cylindrical body made of a frangible molded sintered powder material consisting substantially of metal powder, said body having a tapered substantially conical nose portion thereon, said body being frangible into a multitude of granules upon impact of the body with a target, said body having an internal axial guide opening therein disposed behind said nose portion, a penetrator rod snugly received in said axial opening, said penetrator rod being made of a hard heavy metal composition and being effective to punch a hole in the target upon impact of the penetrator rod with the target, said axial guide opening in said body having an enlarged rear portion, an incendiary pellet snugly and directly received in said enlarged portion of said axial opening and engaging the rear end of said penetrator rod, said pellet having a larger diameter than said penetrator rod, and a massive metal closure plug securely mounted in said enlarged rear portion of said axial opening for securely retaining said incendiary pellet therein and for causing rapid ignition of said incendiary pellet by compression of said pellet and by forcing said pellet through the hole following impact of the projectile with the target whereby ignited particles of said incendiary pellet are energetically propelled through the hole.

2. An ordnance projectile, comprising a frangible porous generally cylindrical body made of a frangible molded sintered powder material consisting substantially of metal powder, said body having a tapered substantially conical nose portion thereon, said metal powder comprising predominantly of stainless steel powder for imparting frangibility to the body whereby the body is frangible into a multitude of granules upon impact of the body with a target, said body having an internal axial guide opening therein disposed behind said nose portion, a penetrator rod snugly received in said axial opening, said penetrator rod being made of a hard heavy composition including tungsten and being effective to punch a hole in the target upon impact of said penetrator rod with the target, an incendiary pellet disposed in said body behind said penetrator rod and engaging the rear end thereof, said axial guide opening in said body having an enlarged rear portion for snugly and directly receiving said incendiary pellet, said pellet having a larger diameter than said penetrator rod, and a massive metal closure plug securely mounted in said enlarged rear portion of said axial opening for securely retaining said incendiary pellet therein and for causing rapid ignition of said incendiary pellet by compression of said pellet and by forcing said pellet through the hole following impact of the projectile with the target whereby ignited particles of said incendiary pellet are energetically propelled through the hole.

3. An ordnance projectile according to claim 2, in which said composition of said penetrator rod consists essentially of tungsten metal.

4. An ordnance projectile according to claim 2, in which said composition of said penetrator rod consists essentially of tungsten carbide.

5. An ordnance projectile, comprising:

a frangible porous generally cylindrical body made of a frangible molded sintered powder material consisting substantially of metal powder, said body having a tapered substantially conical nose portion thereon, said metal powder consisting predominantly of 60–100% stainless steel powder, the remainder of said metal powder being pure iron powder, said body being frangible into a multitude of granules upon impact of said nose portion of said body with a target, said body having an internal axial guide opening therein disposed behind said nose portion, a penetrator rod snugly received in said axial opening, said penetrator rod being made of a hard heavy composition including tungsten and being effective to punch a hole in the target upon impact of said penetrator rod with the target, said axial guide opening in said body having an enlarged rear portion, a substantially cylindrical incendiary pellet snugly and directly received in said enlarged portion of said axial opening and engaging the rear end of said penetrator rod, said pellet having a larger diameter than said penetrator rod, said incendiary pellet comprising zirconium crystals in an epoxy matrix, and a massive metal closure plug securely mounted in said enlarged rear portion of said axial opening for securely retaining said incendiary pellet therein and for causing rapid ignition of said incendiary pellet by compression thereof and by forcing said pellet through the hole following impact of the projectile with the target whereby ignited particles of said incendiary pellet are energetically propelled through the hole.

6. A projectile according to claim 5, in which said composition of said penetrator rod consists essentially of tungsten metal.

7. A projectile according to claim 5, in which said composition of said penetrator rod consists essentially of tungsten carbide.

* * * * *